US009955730B2

(12) United States Patent
Liu

(10) Patent No.: US 9,955,730 B2
(45) Date of Patent: May 1, 2018

(54) ELECTRONIC CIGARETTE

(71) Applicant: KIMREE HI-TECH INC., RoadTown, Tortola (VG)

(72) Inventor: Qiuming Liu, Guangdong (CN)

(73) Assignee: HUIZHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 0 days. days.

(21) Appl. No.: 14/653,540

(22) PCT Filed: Apr. 2, 2014

(86) PCT No.: PCT/CN2014/074651
§ 371 (c)(1),
(2) Date: Jun. 18, 2015

(87) PCT Pub. No.: WO2015/131429
PCT Pub. Date: Sep. 11, 2015

(65) Prior Publication Data

US 2016/0366937 A1 Dec. 22, 2016

(30) Foreign Application Priority Data

Mar. 6, 2014 (CN) ..... 2014 2 0101006 U

(51) Int. Cl.
*A24F 47/00* (2006.01)

(52) U.S. Cl.
CPC ..... *A24F 47/008* (2013.01)

(58) Field of Classification Search
CPC ..... A24F 47/00; A61M 15/06
See application file for complete search history.

(56) References Cited

U.S. PATENT DOCUMENTS

2007/0267031 A1* 11/2007 Hon ..... A24F 47/008 131/273
2011/0277760 A1* 11/2011 Terry ..... A24F 47/008 128/203.12
2013/0255702 A1* 10/2013 Griffith, Jr. ..... A24F 47/008 131/328

FOREIGN PATENT DOCUMENTS

CN 201445686 U 5/2010
CN 202286308 U 7/2012
(Continued)

OTHER PUBLICATIONS

International Search Report corresponding to Application No. PCT/CN2014/074651; dated Nov. 14, 2014.

*Primary Examiner* — Cynthia Szewczyk
(74) *Attorney, Agent, or Firm* — U.S. Fairsky LLP; Yue Xu

(57) ABSTRACT

An electronic cigarette is provided. The electric cigarette includes an electronic cigarette body. The electronic cigarette body is provided with a suction end, an atomizing assembly and a battery rod assembly. The atomizing assembly and the battery assembly are detachablely connected. An accommodating through hole is provided in the atomizing assembly, and the accommodating through hole communicates with an end surface where the atomizing assembly and the battery assembly are connected. An atomizing core for atomizing the cigarette liquid is movably inserted in the accommodating through hole and the atomizing core is in clearance fit with the accommodating through hole. Since the atomizing core is in clearance fit with the accommodating through hole, the atomizing core and the accommodating through hole are not integrated, which is convenient for the user to replace a damaged atomizing core and leads to easy operation and less waste.

14 Claims, 4 Drawing Sheets

(56) References Cited

FOREIGN PATENT DOCUMENTS

| | | | |
|---|---|---|---|
| CN | 203314099 | U | 12/2013 |
| CN | 203388273 | U | 1/2014 |
| GB | 2494315 | A | 3/2013 |
| WO | 2011146372 | A2 | 11/2011 |

* cited by examiner

ELECTRONIC CIGARETTE

CROSS REFERENCE TO RELATED APPLICATIONS

The present application is the national phase of International Application No. PCT/CN2014/074651, filed on Apr. 2, 2014, which claims the priority to Chinese Patent Application No. 201420101006.3, filed on Mar. 6, 2014 with the State Intellectual Property Office of the PRC, which are incorporated herein by reference in their entireties.

FIELD

The present application relates to the technical field of electronic cigarettes, and in particular, to an electronic cigarette in which a damaged atomizing core is convenient to be replaced.

BACKGROUND

The structure of a conventional electronic cigarette is shown in FIG. 1. As can be known from FIG. 1, the conventional electronic cigarette includes an atomizing assembly 110 and a battery rod assembly 120, which are connectable to each other. A suction end 100, through which a user may inhale the aerosol, is arranged on one end of the atomizing assembly 110, where the end is far from the battery rod assembly 120. Further as shown in FIG. 1, the atomizing assembly 110 includes an atomizing core 111 which is integrated with the atomizing assembly 110. The atomizing core is provided with an electric heating wire for atomizing the cigarette liquid and a liquid guiding string for supplying the cigarette liquid to the electric heating wire.

During working, the atomizing core 111 needs to atomize the cigarette liquid into the aerosol to be inhaled by the user. After the atomizing core 111 works for some time, much cigarette liquid may adhere to the surface of the atomizing core 111.

In the case that the atomizing core 111 is damaged, the user can not inhale the aerosol and the atomizing core 111 needs to be replaced. Since the atomizing core 111 is integrated with the atomizing assembly 110, the user needs to replace the whole atomizing assembly 110, the replacement procedure is relative complicated and unnecessary waste is caused. Furthermore, as much cigarette liquid adheres to the surface of the atomizing core 111, the user may get his hands contaminated during the replacement procedure, which results in inconvenience to the user and poor experience of replacement.

SUMMARY

In view of the above, the present application provides an electronic cigarette in which a damaged atomizing core is convenient to be replaced.

An electronic cigarette is provided. The electronic cigarette includes an electronic cigarette body.

The electronic cigarette body is provided with a suction end, an atomizing assembly for atomizing a cigarette liquid, and a battery rod assembly for supplying power to the atomizing assembly. The atomizing assembly and the battery rod assembly are detachablely connected.

An accommodating through hole is provided in the atomizing assembly, the accommodating through hole communicates with a surface of an end of the atomizing assembly, where the end is connected with the battery rod assembly, an atomizing core for atomizing the cigarette liquid is movably inserted in the accommodating through hole, and the atomizing core is in clearance fit with the accommodating through hole.

In the electronic cigarette, a position limitation protrusion, used to prevent the atomizing core from moving in a direction away from the battery rod assembly, is arranged on a hole wall of the accommodating through hole; and a retaining part is provided on an outer surface of the atomizing core, a position of the retaining part corresponds to that of the position limitation protrusion, and the position limitation protrusion abuts against the retaining part.

In the electronic cigarette, the atomizing assembly further comprises an elastic component arranged on a hole wall of the accommodating through hole and an outer wall of the atomizing core, and the elastic component is used to supply the atomizing core with an elastic force toward the battery rod assembly.

In the electronic cigarette, two ends of the elastic component respectively abut the hole wall of the accommodating through hole and the outer wall of the atomizing core; or one end of the elastic component is fixedly connected with the hole wall of the accommodating through hole and the other end of the elastic component abuts against the outer wall of the atomizing core.

In the electronic cigarette, the elastic component is a spring sleeved on the atomizing core, and an axis of the spring and an axis of the atomizing assembly are parallel or the spring and the atomizing assembly are coaxial.

In the electronic cigarette, a first end of the spring abuts against the retaining part;

a second end of the spring abuts against the position limitation protrusion, or the second end of the spring is fixedly connected with the position limitation protrusion; and the spring located between the position limitation protrusion and the retaining part is in a compressed condition.

In the electronic cigarette, the electronic cigarette body is further provided with a liquid container for storing the cigarette liquid, and the liquid container is arranged on one end of the electronic cigarette body, the end being far from the suction end.

In the electronic cigarette, the atomizing core further includes:

a fixation tube;

an electric heating wire, which is arranged on the fixation tube and is used to atomize the cigarette liquid;

a liquid guiding string used to guide the cigarette liquid, where the electric heating wire is wound around the liquid guiding string;

a liquid guiding cotton, which surrounds the fixation tube and is used to guide the cigarette liquid, where the liquid guiding string passes through the fixation tube and is inserted in the liquid guiding cotton;

an atomizing tube, where the liquid guiding cotton is provided in the atomizing tube and the atomizing tube is inserted in the liquid container; and an atomizer electrode, which is arranged at one end of the atomizing tube and is used to electrically connect with the battery rod assembly, where the electric heating wire is electrically connected with the atomizer electrode.

In the electronic cigarette, the atomizing tube is provided with a through hole for delivering the cigarette liquid in the liquid container to the liquid guiding cotton.

In the electronic cigarette, the atomizing assembly is located between the battery rod assembly and the liquid container, the suction end is arranged at one end of the battery rod assembly, the end being far from the atomizing assembly, and the liquid container, the atomizing assembly and the battery rod assembly are coaxially arranged.

In the electronic cigarette, the battery rod assembly includes:

a battery cartridge;

a battery accommodated in the battery cartridge;

a battery electrode, which is electrically connected with the battery and is electrically connected with the atomizer electrode;

a sensing module, used to generate a triggering signal; and a microcontroller, which is electrically connected with the sensing module.

In the electronic cigarette, the sensing module includes:

an airflow sensing switch, which is used to generate the triggering signal in response to a suction performed by a user; or an operation button, which is used to generate the triggering signal in response to a pressing operation of a user.

In the electronic cigarette, an aerosol passage is provided in the battery rod assembly;

where the suction end communicates with a first air inlet via the aerosol passage, the first air inlet is arranged on a surface of the atomizing assembly, and a position of the first air inlet corresponds to that of the electric heating wire; or the suction end communicates with a second air inlet via the aerosol passage, and the second air inlet is arranged on a surface where the atomizing assembly abuts against the liquid container.

In the electronic cigarette, a sealing ring for sealing the liquid container is provided at a place where the atomizing assembly and the liquid container are connected.

In the electronic cigarette, the liquid container is a transparent container.

An electronic cigarette is provided in the present application. The electric cigarette includes an atomizing assembly and a battery rod assembly. An accommodating through hole is provided inside the atomizing assembly, an atomizing core for atomizing the cigarette liquid is movably inserted in the accommodating through hole, and the atomizing core is in clearance fit with the accommodating through hole. Since the atomizing core is in clearance fit with the accommodating through hole, the atomizing core and the accommodating through hole are not integrated, which is convenient for the user to replace a damaged atomizing core, thereby effectively saving the time of replacing the atomizing core by the user and improving the user experience of the replacement.

BRIEF DESCRIPTION OF THE DRAWINGS

For more clearly illustrating technical solutions of embodiments of the present application or conventional technologies, drawings to be used to describe the embodiments or the conventional technologies are briefly described hereinafter. Apparently, the drawings in the following description are only for some embodiments of the present application, and those skilled in the art may obtain other drawings based on these drawings without any creative efforts.

DETAILED DESCRIPTION OF THE EMBODIMENTS

An electronic cigarette is disclosed in the present application and the specific structure of the electronic cigarette according to the present application is described in detail hereinafter in conjunction with FIG. 2.

In an embodiment, an electronic cigarette includes an electronic cigarette body. The electronic cigarette body is provided with a suction end 201 through which a user may smoke. As shown in FIG. 2, the suction end is preferably designed with a shape matching the mouth shape of the user; in practice, the suction end 201 may be designed into other shapes according to other design objects.

An atomizing assembly 203 is provided for atomizing a cigarette liquid into an aerosol.

The electronic cigarette body further includes a battery rod assembly 204 which supplies power to the atomizing assembly 203.

A specific structure of the atomizing assembly 203 according to the embodiment is described in detail hereinafter in conjunction with FIG. 3.

Figure 1:
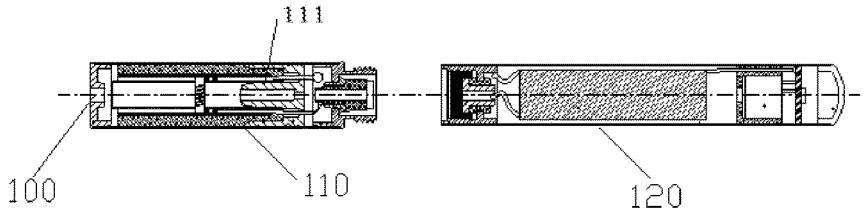
FIG. 1 is a schematic sectional view of a conventional electronic cigarette.
Figure 2:
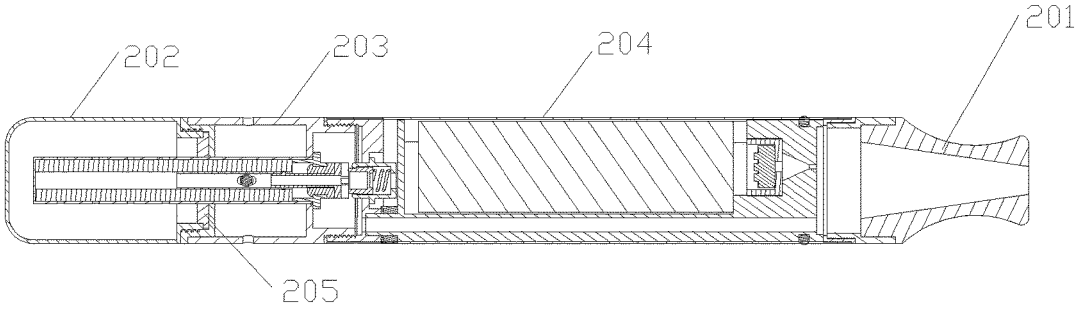
FIG. 2 is a schematic sectional view of an electronic cigarette according to a preferred embodiment of the present application.

An accommodating through hole 301 is provided inside the atomizing assembly 203 according to the embodiment and the accommodating through hole 301 communicates with a surface of an end of the atomizing assembly 203, where the end of the atomizing assembly 302 is connected with the battery rod assembly 204 (as shown in FIG. 2).

An atomizing core 302 for atomizing the cigarette liquid is movably inserted inside the accommodating through hole 301, and the atomizing core 302 is in clearance fit with the accommodating through hole 301.

Figure 4:
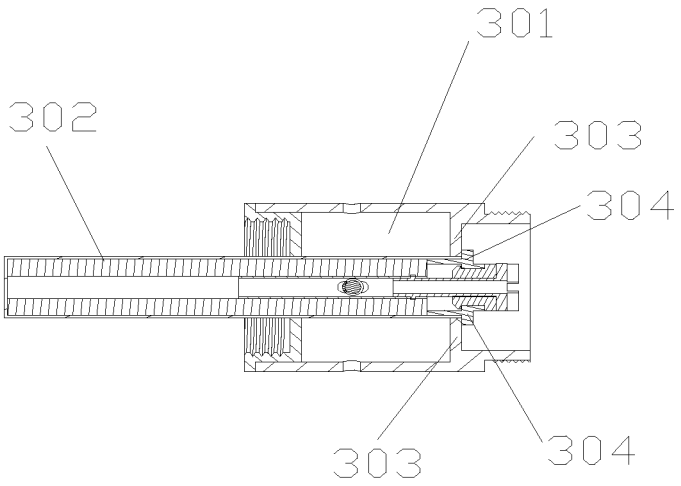
FIG. 4 is a schematic sectional view of an atomizing assembly of an electronic cigarette according to a preferred embodiment of the present application.

The whole structure of the atomizing assembly 203 inserted with the atomizing core 302 is as shown in FIG. 4.

Figure 3:
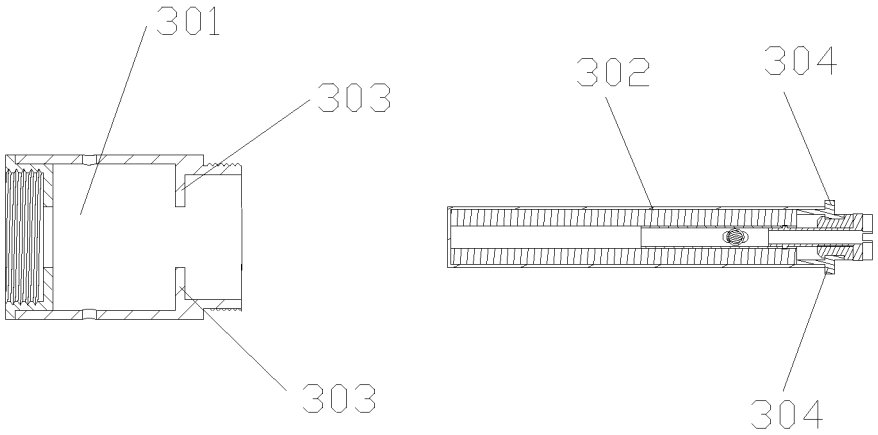
FIG. 3 is a schematic sectional view showing an exploded connecting structure of an atomizing assembly of an electronic cigarette according to a preferred embodiment of the present application.

It is known in conjunction with FIGS. 3 and 4 that, the atomizing core 302 inserted into the accommodating through hole 301 and a hole wall of the accommodating through hole 301 in the atomizing assembly 203 are free-detachable with a movable insertion, rather than fixed through an integration arrangement.

In the embodiment, if the user needs to replace the atomizing core 302 since the atomizing core 302 is damaged and the user can not normally inhale the aerosol, the user merely needs to detach the battery rod assembly 204 from the atomizing assembly 203 and slightly waggle the atomizing assembly 203; and since the atomizing core 302 is in clearance fit with the accommodating through hole 301, the atomizing core 302 may easily depart from the atomizing assembly 203. It is very convenient for the user to replace the atomizing core 302, and during the replacing procedure, the user does not need to touch the atomizing core 302 adhered by the cigarette liquid. Hence, the hand of the user is prevented from getting adhered by the cigarette liquid and the experience of replacing the atomizing core 302 by the user is improved.

A further reference is made to FIGS. 3 and 4 hereinafter and the structure of the electronic cigarette in which the atomizing core 302 is replaceable is described in detail.

As shown in FIG. 3, a hole wall of the accommodating through hole 301 is provided with a position limitation protrusion 303.

A retaining part 304 is provided on an outer surface of the atomizing core 302, and a position of the retaining part 304 corresponds to that of the position limitation protrusion 303.

Since the position of the retaining part 304 corresponds to the position of the position limitation protrusion 303, the position limitation protrusion 303 abuts against the retaining part 304, and the position limitation protrusion 303 prevents the atomizing core 302 from moving in a direction away from the battery rod assembly.

In the case that the user wants to replace the atomizing core 302 and slightly waggles the electronic cigarette, due to a stopping effect of the position limitation protrusion 303, the atomizing core 302 may not move in the direction away from the battery rod assembly 204 but moves in a direction toward the battery rod assembly 204. Therefore, the atomizing core 302 moves in the direction toward the battery rod assembly 204 to depart from the accommodating through hole 301.

It should be noted that, it is just a preferable example that the retaining part 304 is stopped by the position limitation protrusion 303; and the atomizing core 302 moves only in the direction toward the battery rod assembly 204, where the application is not limited to this example.

In the embodiment, an atomizer electrode is provided at one end of the atomizing core 302 and the atomizer electrode is provided with the retaining part 304 which is arranged corresponding to the position limitation protrusion.

Of course, a separately arranged retaining part may be provided to abut against the position limitation protrusion 303, that is, an arranging manner of a specific abutting between the atomizing core 302 and the accommodating through hole 301 is not limited as long as the clearance fit between the atomizing core 302 and the accommodating through hole 301 can be realized.

Furthermore, to smoothly and efficiently replace the atomizing core 302, the battery rod assembly 204 and the atomizing assembly are detachablely connected. A specific detachable connecting manner is not limited in the embodiment, for example, a thread connection or a buckle coupling may be employed.

The structure of an electronic cigarette, in which the atomizing core 302 and the atomizing assembly 203 can be detached from each other with a high efficiency, is described in detail hereinafter in conjunction with FIG. 5.

To make a process of detaching the atomizing core 302 much smoother and to increase the detaching efficiency, the atomizing assembly 203 further includes an elastic component.

The elastic component is provided at the hole wall of the accommodating through hole 301 and at the outer wall of the atomizing core 302.

The elastic component is for supplying the atomizing core 302 with an elastic force toward the battery rod assembly 204.

During a process of replacing the atomizing core 302 by the user, once the battery rod assembly 204, which is detachablely connected with the atomizing assembly 203, is detached from the atomizing assembly 203, due to an elastic effect of the elastic component, an elastic force toward the battery rod assembly 204 is exerted on the atomizing core 302 and the atomizing core 302 automatically pops out, thereby further increasing the efficiency in replacing the atomizing core 302. Furthermore, the electrical connection between the atomizer electrode and the battery rod assembly is more reliable with the elastic effect of the elastic component.

It should be noted that, a specific structure of the elastic component and a position where the elastic component is arranged are not limited in the embodiment as long as the elastic component can supply the atomizing core 302 with an elastic force toward the battery rod assembly 204.

For example, two ends of the elastic component may respectively abut against the hole wall of the accommodating through hole 301 and the outer wall of the atomizing core 302. This arranging manner is employed to decrease processes of assembling the electronic cigarette and to save the production cost, and may be implemented by arranging the elastic component inside the electronic cigarette body and abutting the elastic component against the hole wall of the accommodating through hole 301 and the outer wall of the atomizing core 302.

Alternatively, one end of the elastic component is fixedly connected with the hole wall of the accommodating through hole 301 and another end of the elastic component abuts against the outer wall of the atomizing core 302. With such arranging manner, the elastic component and the hole wall of the accommodating through hole 301 are fixedly connected, and accordingly, the elastic force supplied by the elastic component is stable and may not be lost. The user may not perform additional operations when replacing the atomizing core 302, and the elastic component is prevented from dropping out together with the atomizing core 302 when the elastic component pops the atomizing core 302 out.

A specific structure of the elastic component is described in detail hereinafter in conjunction with FIG. 6.

The elastic component is a spring 601 sleeved on the atomizing core 302 and the spring 601 and the atomizing assembly 203 are coaxial.

Figure 6:
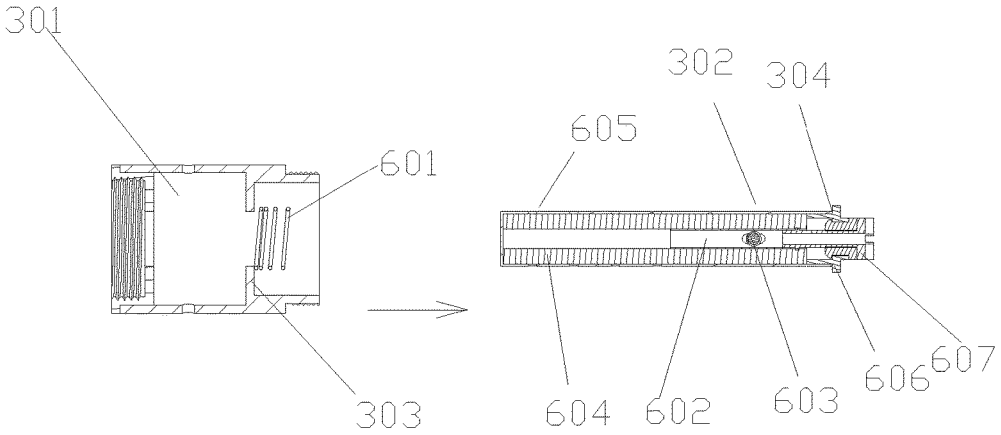
FIG. 6 is a schematic sectional view showing an exploded connecting structure of an atomizing assembly of an electronic cigarette according to another preferred embodiment of the present application.

Of course, a specific position of the spring 601 is not limited in the embodiment, as long as the spring 601 can supply the atomizing core 302 with an elastic force in a direction toward the battery rod assembly 204, where the direction is indicated by an arrow shown in FIG. 6.

For example, the axis of the spring 601 is parallel to that of the atomizing assembly 203.

A further reference is made to FIG. 6 and a specific position where the spring 601 is arranged in the atomizing assembly 203 is described in detail.

It should be noted that, the specific position where the spring 601 is arranged is not limited in the embodiment, as long as the spring 601 can supply the atomizing core 302 with an elastic force toward the battery rod assembly 204.

In a first arranging manner of the spring 601, a first end of the spring 601 abuts against the retaining part 304, where the specific structure of the retaining part 304 may be seen with reference to the embodiment shown in FIGS. 3 and 4 and is not described in the embodiment; and a second end of the spring 601 abuts on the position limitation protrusion 303, where the specific structure of the position limitation protrusion 303 may be seen with reference to the embodiment of FIGS. 3 and 4 and is not described in the embodiment.

In a second arranging manner of the spring 601, a first end of the spring 601 abuts against the atomizer electrode, the atomizer electrode is provided at one end of the atomizing core 302 and corresponds to the position of the position limitation protrusion 303, where the specific structure of the atomizer electrode may be seen in an embodiment described below and is not described in the embodiment; and a second end of the spring 601 abuts against the position limitation protrusion 303, where the specific structure of the position limit protrusion 303 may be seen with reference to the embodiment of FIGS. 3 and 4 and is not described in the embodiment.

In a third arranging manner of the spring 601, a first end of the spring 601 abuts against the retaining part 304; and a second end of the spring 601 is fixedly connected with the position limitation protrusion 303.

In a fourth arranging manner of the spring 601, a first end of the spring 601 abuts against the atomizer electrode; and a second end of the spring 601 is fixedly connected with the position limitation protrusion 303.

Figure 5:
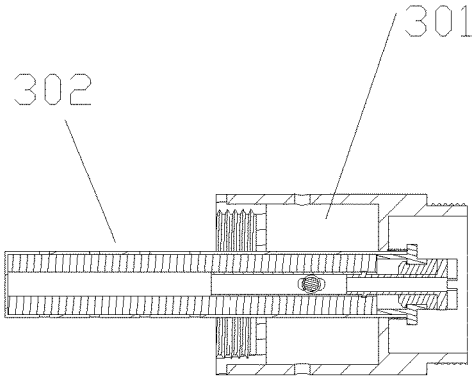
FIG. 5 is a schematic sectional view of an atomizing assembly of an electronic cigarette according to another preferred embodiment of the present application.

As shown in FIG. 5, the spring 601 is in a compressed state via the arranging manners above. During the process of replacing the atomizing core 302 by the user, first the battery rod assembly 204 of the electronic cigarette needs to be detached from the atomizing assembly 203; after the battery rod assembly is detached, the atomizing assembly 203 may not suffer a pressure from the battery rod assembly 204, and the spring 601 in the compressed state exerts an elastic force on the atomizing core 302, where the elastic force is toward the battery rod assembly 204 and the direction of the elastic force is indicated by the arrow shown in FIG. 6. The atomizing core 302 automatically pops out under the effect of the elastic force, thereby increasing the efficiency in replacing the atomizing core 302 by the user. In addition, the user needs not to touch the atomizing core 302 adhered by the cigarette liquid; hence, the experience of replacement performed by the user is improved while the efficiency is increased.

Of course, the arranging manners of the spring are merely preferred examples. The specific arranging manner is not limited in the embodiment, for example, an arranging manner with multiple springs may be used.

A specific structure of the electronic cigarette according to the embodiment is described in detail hereinafter in conjunction with FIG. 2.

As shown in FIG. 2, the electronic cigarette body is further provided with a liquid container 202 for storing the cigarette liquid, and the liquid container 202 is arranged on one end of the electronic cigarette body, where the end is far from the suction end 201.

It can be further known from FIG. 2, the atomizing assembly 203 is located between the battery rod assembly 204 and the liquid container 202, and the suction end 201 is arranged at one end of the battery rod assembly 204, where the end is far from the atomizing assembly 203. The liquid container, the electronic cigarette and the battery rod assembly are coaxially arranged.

Advantages of employing such arranging manner are described as follows. Since the position of the liquid container 202 is arranged far from the suction end 201, an aerosol passage in the electronic cigarette body may not pass through the liquid container 202, unatomized cigarette liquid in the liquid container 202 may not get leaked into the aerosol passage, and the user may not inhale the unatomized cigarette liquid, thereby effectively preventing a leakage of the cigarette liquid. In addition, the cigarette liquid is prevented from condensing in the aerosol passage which does not pass through the liquid container 202; therefore, the aerosol passage is effectively prevented from getting blocked by condensed cigarette liquid.

The specific structure of the electronic cigarette according to the embodiment is further described in detail in conjunction with FIG. 2. The atomizing assembly 203 is located between the battery rod assembly 204 and the liquid container 202, and the suction end 201 is located at the outside of one end of the battery rod assembly 204, or located in a middle portion of the battery rod assembly 204, or located at a position on the battery rod assembly 204, where the position is far from the atomizing assembly 203.

The suction end 201 located at the outside of one end of the battery rod assembly 204 and the battery rod assembly 204 may be coaxially arranged. Via employing such arranging manner, the shape of the electronic cigarette intuitively simulates that of a tobacco cigarette, and the accumulation of the cigarette liquid can be effectively reduced since the whole aerosol passage is relative straight.

Alternatively, the suction end 201 may be arranged at a middle portion of the battery rod assembly 204 or at a position on the battery rod assembly 204 far from the atomizing assembly 203.

A specific position of the suction end 201 is not limited in the present application.

In the embodiment, to provide the electronic cigarette with a whole structure simulating that of the tobacco cigarette, to accord with accustomed usage of the user and to reduce the accumulation of the cigarette liquid, the atomizing assembly 203 and the battery rod assembly 204 are coaxially arranged.

In the embodiment, the atomizing assembly 203 is located between the battery rod assembly 204 and the liquid container 202, that is, the atomizing assembly 203 is far from the suction end 201. When the user smokes with the electronic cigarette according to the embodiment, the position of the atomizing assembly 203 is far from the mouth of the user; hence, the heat generated during the atomizing assembly 203 atomizes the cigarette liquid may not scald the user and the security of using the electronic cigarette is effectively improved. Furthermore, during smoking, the user generally clamps the battery rod assembly 204 to smoke, rather than clamps the atomizing assembly 203 which is heated up as in the conventional technology; hence, the user may not get his hand scalded when smoking with the electronic cigarette according to the embodiment, while the temperature of the tobacco cigarette is effectively simulated and the user experience of smoking is improved.

Preferably, to enable the user to acquire the quantity of the cigarette liquid remained in the liquid container 202, the liquid container 202 is a transparent container. The user can acquire the quantity of the remained cigarette liquid in the electronic cigarette at any time via the transparent liquid container 202 and may replace the liquid container 202 conveniently and timely.

Preferably, the liquid container 202 is a glass bottle. Since the property of glass is stable, the flavor of the cigarette liquid is prevented from getting affected by chemical reactions.

More preferably, an outer wall of the liquid container 202 made of glass is provided with a scale, such that the user may estimate an available duration to smoke with the remained cigarette liquid, which is convenient for usage.

Preferably, a protective sleeve (not shown in drawings) is sleeved on the liquid container 202, to prevent the liquid container 202 made of glass from being broken due to a falling down.

More preferably, the protective sleeve is provided with a cigarette liquid observation window through which the user observes the cigarette liquid.

To simulate the tobacco cigarette, the length of the electronic cigarette is generally equal to that of the tobacco cigarette. To reduce a charging frequency and ensure the battery rod assembly 204 with a long lifetime, the length of the battery rod assembly 204 may be equal to or larger than half of the whole length of the electronic cigarette; and when smoking with the electronic cigarette according to the embodiment, the user naturally clamps a middle or upper portion of the electronic cigarette which is close to the suction end 201. Since the liquid container 202 is arranged at one end far from the suction end 201, the liquid container 202 is prevented from being clamped by the user, and a relative balanced quantity of cigarette liquid is delivered from the liquid container 202 to the atomizing assembly 203, thereby effectively ensuring a stable aerosol and improving the user experience. A conventional situation of an unstable amount of aerosol due to different amounts of supplied cigarette liquid caused by different forces exerted by the user on an end portion of the liquid container is avoided.

To effectively ensure the liquid container 202 with a good airtightness and effectively prevent a leakage of the cigarette liquid, two arranging manners may be employed in the embodiment.

A first arranging manner is as shown in FIG. 2. To ensure the liquid container 202, which is detachablely connected to the atomizing assembly 203, with a good airtightness and prevent a leakage of the cigarette liquid in the liquid container 202, a sealing ring 205 for sealing the liquid container 202 is provided at a place where the atomizing assembly 203 and the liquid container 202 are connected.

The airtightness of the liquid container 202 can be effectively ensured by the sealing ring 205.

Figure 7:
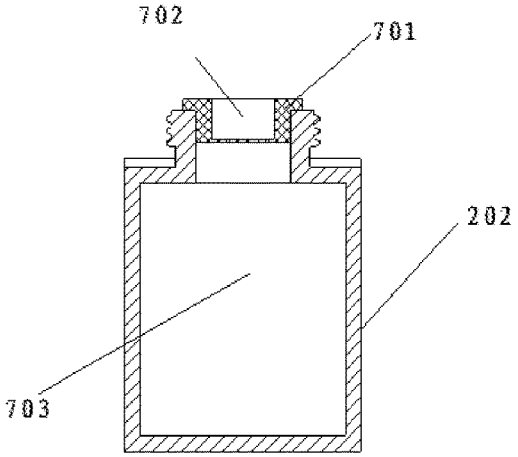
FIG. 7 is a schematic sectional view of a liquid container of an electronic cigarette according to a preferred embodiment of the present application.

A second arranging manner is as shown in FIG. 7. An annular sealing plug 701 having a through hole is provided at an opening of the liquid container 202, and the annular sealing plug matches with the opening and seals the opening.

A pierceable membrane 702 for sealing the liquid container 202 is provided inside the through hole of the annular sealing plug 701.

When the atomizing core 302 is inserted into a sealed accommodating chamber 703 of the liquid container 202, the atomizing core 302 passes through the pierceable membrane 702, and with the pierceable membrane 702, the liquid container 202 inserted by the atomizing core 302 still has a good airtightness, thereby effectively preventing the leakage of the cigarette liquid.

Since the liquid container 202 according to the embodiment is provided with the annular sealing plug 701 having the pierceable membrane 702, the liquid container 202 has a good airtightness, the leakage of the cigarette liquid is effectively prevented, and the electronic cigarette is ensured with a long lifetime.

FIG. 6 is further taken as an example to detail the specific structure of the atomizing core 302.

The atomizing core 302 includes:

- a fixation tube 602;
- an electric heating wire 603, which is arranged on the fixation tube 602 and used to atomize the cigarette liquid;
- a liquid guiding string used to guide the cigarette liquid, where the electric heating wire 603 is wound around the liquid guiding string;
- a liquid guiding cotton 604, which surrounds the fixation tube 602 and is for guiding the cigarette liquid; where the liquid guiding string passes through the fixation tube 602 and is inserted into the liquid guiding cotton 604 to guide the cigarette liquid in the liquid guiding cotton 604 to the electric heating wire 603, and the fixation tube 602 is clamped and fixed by the liquid guiding cotton 604;
- an atomizing tube 605, where the liquid guiding cotton 604 is provided inside the atomizing tube 605 and the atomizing tube 605 is inserted in the liquid container 202; and
- an atomizer electrode, which is arranged at one end of the atomizing tube 605 and used to electrically connect with the battery rod assembly, where the electric heating wire 603 is electrically connected with the atomizer electrode.

To deliver the cigarette liquid from the liquid container 202 to the liquid guiding cotton 604, the atomizing tube 605 is provided with a through hole used to deliver the cigarette liquid from the liquid container 202 to the liquid guiding cotton 604.

That is, the liquid guiding cotton 604 in the atomizing tube 605 may absorb the cigarette liquid in the liquid container via the through hole.

It should be noted that, in the electronic cigarette according to the embodiment, the structure for delivering the cigarette liquid to the electric heating wire 603 is merely an example and is not limited herein, as long as the cigarette liquid can be delivered to the electric heating wire 603.

For example, instead of applying the atomizing tube 605 and the liquid guiding cotton 604, a liquid guiding pillar made of an oil-absorptive material may be arranged surrounding the fixation tube 602, and the liquid guiding pillar is exposed and inserted into the liquid container 202. The liquid guiding pillar may be a cotton workpiece or a fiberglass workpiece. Of course, the liquid guiding pillar may be a workpiece made of a porous material, and the liquid guiding pillar made of the porous material delivers the cigarette liquid to the electric heating wire 603 through the capillarity.

Preferably, the liquid guiding pillar is a fiberglass workpiece. The flavor of the cigarette liquid may not be affected since the fiberglass workpiece can withstand high heat and has a stable property, and it is favorable to improve the feeling and stability of inhaling the aerosol by the user.

An opening may be arranged at a bottom of the atomizing tube 605, and the cigarette liquid in the liquid container 202 can be delivered to the liquid guiding cotton 604 through the opening.

Specifically, the atomizer electrode includes a first electrode 606 and a second electrode 607 which are respectively electrically connected with the electric heating wire 603.

In the embodiments above, the spring 604 may abut against the first electrode 606 of the atomizer electrode.

A specific structure of the battery rod assembly 204 of the electronic cigarette is described in detail hereinafter in conjunction with an embodiment shown in FIG. 8.

The battery rod assembly 204 includes:

a battery cartridge 801, a battery 802, a battery electrode 803, a sensing module and a microcontroller.

Figure 8:
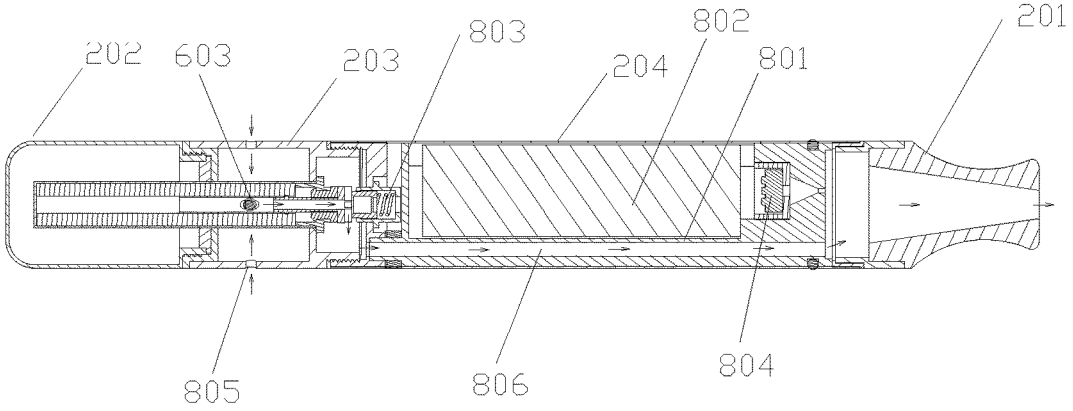
FIG. 8 is a schematic sectional view of an electronic cigarette according to another preferred embodiment of the present application.

A suction end 201 shown in FIG. 8 may be integrated with the battery cartridge 801 and may be formed through an extension of one end portion of the battery cartridge 801; or a suction nozzle serving as the suction end 201 is detachablely connected with the battery cartridge 801; the specific arranging manner is not limited in the embodiment.

In an embodiment, since the suction nozzle serving as the suction end 201 is detachablely connected, the user can replace or clean the suction nozzle at any time to avoid inhaling the cigarette liquid in the suction nozzle and to better clean the cigarette liquid in the battery rod assembly.

The battery 802 is arranged inside the battery cartridge 801.

The battery electrode 803 is electrically connected with the battery 802, and the battery electrode 803 is electrically connected with the atomizer electrode.

Preferably, in an embodiment, the battery electrode 803 may be a spring electrode.

The sensing module is used to generate a triggering signal.

The microcontroller is electrically connected with the sensing module.

As shown in FIG. 8, in the embodiment, the sensing module is preferably an airflow sensing switch 804.

When the user sucks the suction end 201, a pressure in the electronic cigarette decreases, and the airflow sensing switch 804 generates the triggering signal after detecting the decrease of the pressure.

After detecting the triggering signal, the microcontroller controls the battery 608 of the battery rod assembly 204 to supply power to the electronic cigarette, such that the electric heating wire 603 of the electronic cigarette atomizes the cigarette liquid to generate the aerosol to be inhaled by the user.

In the embodiment, since the airflow sensing switch 804 is close to the suction end 201, the sensitivity of the airflow sensing switch 804 in sensing a suction performed by the user is increased; therefore, the user can use the electronic cigarette more effectively.

Of course, the arranging manner of the sensing module is not merely limited to that shown in FIG. 8. For example, an operation button may be provided on a surface of the electronic cigarette. The user presses the operation button if he or she wants to inhale the aerosol, the operation button generates a triggering signal in response to the operation of the user, and after detecting the triggering signal, the microcontroller controls the battery 608 of the battery rod assembly 204 to supply power to the electronic cigarette, such that the electric heating wire 603 of the electronic cigarette atomizes the cigarette liquid to generate the aerosol to be inhaled by the user.

A further reference is made to FIG. 8 to detail an aerosol passage formed inside the electronic cigarette.

The aerosol passage 806 is arranged inside the battery rod assembly 204 and is to communicate the suction end 201 with a first air inlet 805.

Preferably, the aerosol passage 806 is hermetically arranged inside the battery rod assembly 204, that is, the aerosol passage 806 is isolated from other electronic elements in the battery rod assembly 204.

Specifically, there may be two arranging manners for the air inlet which communicates with the aerosol passage 806. It should be noted that, the arranging manner for the air inlet is merely explained with examples and is not limited hereinafter, as long as the air inlet arranged at the electronic cigarette body communicates with the suction end 201 via the aerosol passage 806.

A first arranging manner for the air inlet may be shown in FIG. 8. The first air inlet 805 is arranged on an outer wall of the atomizing assembly 203 and is located at a position corresponding to that of the electric heating wire 603.

The suction end 201 communicates with the first air inlet 805 via the aerosol passage 806, which is specifically shown in FIG. 8, where FIG. 8 is a schematic sectional view of an electronic cigarette in which the air inlet is arranged on the outer wall of the atomizing assembly 203.

As can be known from FIG. 8, the first air inlet 805 arranged on the outer wall of the atomizing assembly 203 communicates with the suction end 201 via the aerosol passage 806.

Specifically in the embodiment, directions of the airflow inside the electronic cigarette are indicated by arrows shown in FIG. 8. The airflow dose not pass through the liquid container 202, and accordingly, the aerosol generated through atomization performed by the atomizing assembly 203 may flow to the suction end 201 without passing through the liquid container 202. Hence, the aerosol may not be condensed due to heat-absorption of the liquid container 202 and the aerosol passage 806 may not be blocked, thereby avoiding conventional problems that the aerosol passing through a liquid storage area is condensed and an atomizing passage is blocked.

A second arranging manner is described as follows. A second air input may be arranged on a surface where the atomizing assembly 203 abuts against the liquid container 202. Specifically, a bump or a protruding rib portion may be arranged on the surface where the atomizing assembly 203 abuts against the liquid container 202, such that the second air input for the entering of air is formed between the atomizing assembly 203 and the liquid container 202 which are in a thread connection, and the air flows into the aerosol passage 806 via the second air inlet.

It should be noted that, how the second air inlet is arranged is not limited, as long as the second air inlet for the entering of air is formed between the atomizing assembly 203 and the liquid container 202.

That is, the second air inlet, which is arranged on the surface where the atomizing assembly 203 abuts against the liquid container 202, communicates with the suction end 201 via the aerosol passage 806.

Since the airflow inside the electronic cigarette according to the embodiment does not pass through the liquid container 202, the aerosol generated through atomization performed by the atomizing assembly 203 may flow to the suction end 201 without passing through the liquid container 202; hence, the aerosol may not get condensed due to heat-absorption of the liquid container 202 and the aerosol passage 806 may not be blocked.

The technical solutions in the embodiments of the present application are described clearly and completely hereinafter in conjunction with the drawings in the embodiments of the present application. Apparently, the described embodiments are only a part of rather than all embodiments of the present application. Based on the embodiments in the present application, all other embodiments made by those skilled in the art without any creative efforts fall into the protection scope of the present application.

The embodiments in the specification are described in a progressive way, each embodiment emphasizes on differences from others, and identical or similar parts among the embodiments can be understood with reference to each other.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. An electronic cigarette, comprising an electronic cigarette body, wherein the electronic cigarette body is provided with a suction end, an atomizing assembly for atomizing a cigarette liquid, and a battery rod assembly for supplying power to the atomizing assembly, and the atomizing assembly and the battery rod assembly are detachablely connected; and wherein an accommodating through hole is provided in the atomizing assembly, the accommodating through hole communicates with a surface of an end of the atomizing assembly, the end being connected with the battery rod assembly, an atomizing core for atomizing the cigarette liquid is movably inserted in the accommodating through hole, and the atomizing core is in clearance fit with the accommodating through hole; and wherein the atomizing core comprises:

a fixation tube;

an electric heating wire, which is arranged on the fixation tube and is configured to atomize the cigarette liquid;

a liquid guiding string configured to guide the cigarette liquid, wherein the electric heating wire is wound around the liquid guiding string;

a liquid guiding cotton, which surrounds the fixation tube and is configured to guide the cigarette liquid, wherein the liquid guiding string passes through the fixation tube and is inserted in the liquid guiding cotton;

an atomizing tube, wherein the liquid guiding cotton is provided in the atomizing tube and the atomizing tube is inserted in a liquid container; and an atomizer electrode, which is arranged at one end of the atomizing tube and is configured to electrically connect with the battery rod assembly, wherein the electric heating wire is electrically connected with the atomizer electrode.

2. The electronic cigarette according to claim 1, wherein a position limitation protrusion, configured to prevent the atomizing core from moving in a direction away from the battery rod assembly, is arranged on a hole wall of the accommodating through hole; and a retaining part is provided on an outer surface of the atomizing core, a position of the retaining part corresponds to that of the position limitation protrusion, and the position limitation protrusion abuts against the retaining part.

3. The electronic cigarette according to claim 2, wherein the atomizing assembly further comprises an elastic component arranged on a hole wall of the accommodating through hole and an outer wall of the atomizing core, and the elastic component is configured to supply the atomizing core with an elastic force toward the battery rod assembly.

4. The electronic cigarette according to claim 3, wherein two ends of the elastic component respectively abut the hole wall of the accommodating through hole and the outer wall of the atomizing core; or one end of the elastic component is fixedly connected with the hole wall of the accommodating through hole and the other end of the elastic component abuts against the outer wall of the atomizing core.

5. The electronic cigarette according to claim 4, wherein the elastic component is a spring sleeved on the atomizing core, and an axis of the spring and an axis of the atomizing assembly are parallel, or the spring and the atomizing assembly are coaxial.

6. The electronic cigarette according to claim 5, wherein a first end of the spring abuts against a retaining part;

a second end of the spring abuts against a position limitation protrusion, or the second end of the spring is fixedly connected with the position limitation protrusion; and the spring located between the position limitation protrusion and the retaining part is in a compressed condition.

7. The electronic cigarette according to claim 1, wherein the electronic cigarette body is further provided with a liquid container for storing the cigarette liquid, and the liquid container is arranged on one end of the electronic cigarette body, the end being far from the suction end.

8. The electronic cigarette according to claim 1, wherein the atomizing tube is provided with a through hole for delivering the cigarette liquid in the liquid container to the liquid guiding cotton.

9. The electronic cigarette according to claim 8, wherein a sealing ring for sealing the liquid container is provided at a place where the atomizing assembly and the liquid container are connected.

10. The electronic cigarette according to claim 1, wherein the atomizing assembly is located between the battery rod assembly and the liquid container, the suction end is arranged at one end of the battery rod assembly, the end being far from the atomizing assembly, and a liquid container, the atomizing assembly and the battery rod assembly are coaxially arranged.

11. The electronic cigarette according to claim 1, wherein the battery rod assembly comprises:

a battery cartridge;

a battery accommodated in the battery cartridge;

a battery electrode, which is electrically connected with the battery and is electrically connected with the atomizer electrode;

a sensing module, configured to generate a triggering signal; and a microcontroller, which is electrically connected with the sensing module.

12. The electronic cigarette according to claim 11, wherein the sensing module comprises:

an airflow sensing switch, which is configured to generate the triggering signal in response to a suction performed by a user; or an operation button, which is configured to generate the triggering signal in response to a pressing operation of a user.

13. The electronic cigarette according to claim 11, wherein an aerosol passage is provided in the battery rod assembly;

wherein the suction end communicates with a first air inlet via the aerosol passage, the first air inlet is arranged on a surface of the atomizing assembly, and a position of the first air inlet corresponds to that of the electric heating wire; or the suction end communicates with a second air inlet via the aerosol passage, and the second air inlet is arranged on a surface where the atomizing assembly abuts against the liquid container.

14. The electronic cigarette according to claim 13, wherein the liquid container is a transparent container.

* * * * *